US010262813B2

(12) United States Patent
Pierres et al.

(10) Patent No.: US 10,262,813 B2
(45) Date of Patent: Apr. 16, 2019

(54) CIRCUIT BREAKER CONTAINING A GAS ESCAPE HOOD WITH SEALABLE OPENING

(71) Applicant: General Electric Technology GmbH, Baden (CH)

(72) Inventors: Emilien Pierres, Lyons (FR); Nicolas Toquet, Saint Thibaud de Couz (FR); Roger Ledru, Tignieu (FR); Jean-Baptiste Jourjon, Chambery (FR); Laurent Boget, Aix les Bains (FR)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 11 days.

(21) Appl. No.: 15/537,101

(22) PCT Filed: Dec. 18, 2015

(86) PCT No.: PCT/EP2015/080420
§ 371 (c)(1),
(2) Date: Jun. 16, 2017

(87) PCT Pub. No.: WO2016/097258
PCT Pub. Date: Jun. 23, 2016

(65) Prior Publication Data

US 2018/0261406 A1 Sep. 13, 2018

(30) Foreign Application Priority Data

Dec. 19, 2014 (FR) ..... 14 62907

(51) Int. Cl.

| | |
|---|---|
| ***H01H 9/34*** | (2006.01) |
| ***H01H 33/88*** | (2006.01) |
| ***H01H 33/90*** | (2006.01) |

(52) U.S. Cl.
CPC ..... *H01H 9/342* (2013.01); *H01H 33/88* (2013.01); *H01H 33/903* (2013.01); *H01H 2033/888* (2013.01); *H01H 2033/908* (2013.01)

(58) Field of Classification Search
CPC ..... H01H 9/342; H01H 1/385; H01H 33/53; H01H 33/74; H01H 33/7014;
(Continued)

(56) References Cited

U.S. PATENT DOCUMENTS

| | | | | |
|---|---|---|---|---|
| 4,983,789 | A | 6/1991 | Thuries | |
| 7,022,922 | B2 * | 4/2006 | Nowakowski | H01H 33/88 200/12 |

(Continued)

FOREIGN PATENT DOCUMENTS

| | | | |
|---|---|---|---|
| DE | 10 2011 083 593 | A1 | 3/2013 |
| EP | 0 380 907 | A1 | 8/1990 |

(Continued)

OTHER PUBLICATIONS

Search Report issued in French Patent Application No. 1462907 dated Nov. 13, 2015.

(Continued)

*Primary Examiner* — Edwin A. Leon
*Assistant Examiner* — William A Bolton
(74) *Attorney, Agent, or Firm* — Pearne & Gordon LLP

(57) ABSTRACT

A medium-, high-, or very high-voltage circuit breaker (10), comprising at least one arc-control chamber (12) and an outer casing (14) in which the arc-control chamber (12) is arranged. In the invention, the circuit breaker includes sealing ring (52) for sealing an opening (50) in a discharge cap (40) of the arc-control chamber (12), the ring (52) being movable between a sealing position and a retracted position in which they allow the gas to pass, the circuit breaker being configured in such a manner that in the closed position, the (Continued)

sealing ring (52) are in their retracted position, and in such a manner that passage from the retracted position to the sealing position takes place during an operation of opening the circuit breaker.

8 Claims, 5 Drawing Sheets

(58) Field of Classification Search
CPC ..... H01H 33/7084; H01H 33/88; H01H 2033/888; H01H 2033/908; H01H 33/72
USPC ..... 218/51, 52, 57, 59, 61, 99, 97
See application file for complete search history.

(56) References Cited

U.S. PATENT DOCUMENTS 7,893,379 B2 * 2/2011 Schoenemann ..... H01H 33/74 218/157
8,530,774 B2 * 9/2013 Grieshaber ..... H01H 33/7015 218/51
2013/0126481 A1 * 5/2013 Ozil ..... H01H 33/901 218/157
2014/0084935 A1 3/2014 Chatroux

FOREIGN PATENT DOCUMENTS

FR 2 575 595 A1 7/1986
FR 2 976 085 A1 12/2012

OTHER PUBLICATIONS

Search Report issued in International Application No. PCT/EP2015/080420 dated Mar. 8, 2016.
Written Opinion issued in International Application No. PCT/EP2015/080420 dated Mar. 8, 2016.

* cited by examiner

CIRCUIT BREAKER CONTAINING A GAS ESCAPE HOOD WITH SEALABLE OPENING

TECHNICAL FIELD

The invention relates to the field of medium-, high-, or very high-voltage circuit breakers. It relates more particularly to the problem of the arc-control chamber heating by the Joule effect while it is in the closed position, and also to managing the discharging of hot gas that results from blasting the electric arc during an operation of opening the circuit breaker.

STATE OF THE PRIOR ART

From the prior art, numerous circuit breaker designs are known, such as for example, the design described in document DE 10 2011 083593. Such a circuit breaker incorporates a discharge cap with openings made therein to allow gas to be evacuated.

In the closed position, the circuit breaker has current passing therethrough that, by the Joule effect, releases energy in the form of heat at the electrical interfaces, into the arc-control chamber. The openings in the discharge cap must therefore be large enough to enable the hot gas to be evacuated towards the volume of gas defined by the outer casing of the tank without damaging the electrical interfaces.

However, during opening of the circuit breaker, the hot gas that results from blasting the electric arc passes through said openings so as to be extracted into the arc-control chamber towards the outer casing of the circuit breaker.

This outer casing is thus subjected to risks of attack from the hot gas and from the microparticles entrained by said gas. In addition, for shielded circuit breakers of the gas-insulated switchgear (GIS) or "dead tank" type, an electrical insulation fault may form via the hot gas and give rise to electric arcing between a portion of the chamber that is electrically charged (at a non-zero potential) and the metal outer casing of the circuit breaker that is at zero potential. In order to limit this risk, in this situation the openings through the discharge cap must not be too large, so as to reduce the stream of hot gas flowing towards the outer casing.

Consequently, there exists a need to optimize the design of such circuit breakers, in such a manner as to provide a satisfactory response to the problem of the circuit breaker heating in the closed position, as well as to the problem of discharging the hot gas that results from blasting the electric arc during an operation of opening the circuit breaker.

SUMMARY OF THE INVENTION

In order to meet this need, the invention provides a medium-, high-, or very high-voltage circuit breaker, comprising at least one arc-control chamber and an outer casing defining a space in which the arc-control chamber is arranged, said arc-control chamber comprising:

- a first set of electrical contacts and a second set of electrical contacts, at least one of the first and second sets being movable in such a manner as to enable closing and opening operations of the circuit breaker;
- an arc blast nozzle; and
- a discharge cap situated in the space and comprising an end wall and a side wall internally defining a gas-flow chamber situated at least in part downstream from the blast nozzle, the discharge cap including at least one opening for evacuating gas.

According to the invention, the circuit breaker includes sealing means for sealing said opening, said sealing means being movable between a sealing position in which they prevent the gas from passing through the opening, and a retracted position in which they allow passage therethrough, the circuit breaker being configured in such a manner that in its closed position, said sealing means are in their retracted position, and in such a manner that passage from the retracted position to the sealing position takes place during an operation of opening the circuit breaker.

The invention initially presents the advantage of reducing the temperature in the arc-control chamber in normal operation, when the circuit breaker is in the closed position. Removing the sealing means from the opening enables natural convection to take place towards the inside space defined by the casing. Also, the effects of heating the arc-control chamber that are caused by current passing when the circuit breaker is in the closed position, may be considerably lessened.

In addition, the invention provides sealing of the opening during an operation of opening the circuit breaker. Consequently, as soon as said opening is sealed, the hot gas resulting from blasting the arc remains confined in the chamber, and that limits the risk of attack on the outer casing of the circuit breaker by said hot gas and by the microparticles that it entrains, and also the risk of arcing between the arc-control chamber of the circuit breaker and the outer casing.

The invention further provides at least one of the following optional characteristics, alone or in combination.

The circuit breaker is configured in such a manner that the sealing position is maintained until the end of the operation of opening the circuit breaker, and passage from the sealing position to the retracted position takes place during the following operation of closing the circuit breaker. By maintaining the sealing position until the end of the operation of opening the circuit breaker, the risk of the outer casing of the circuit breaker being attacked is further reduced. The sealing means may be returned to the retracted position at the start or at the end of the operation of closing the circuit breaker or at any instant between these two moments. In addition, it should be observed that the passage from the sealing position to the retracted position may be sudden or gradual, as a function of the design selected.

The circuit breaker is configured in such a manner that passage from the retracted position to the sealing position takes place after the operation of opening the circuit breaker has been initiated. This makes it possible to evacuate all or some of the high-pressure cold gas that is present in the arc-control chamber just after the operation of opening the circuit breaker has been initiated. As a result of this cold initial front being evacuated, the pressure in the chamber diminishes, and the mechanical forces required for moving the electrical contacts are advantageously reduced. In addition, during the remainder of the opening operation, this preliminary evacuation makes it possible to increase the pressure difference between the core of the chamber and the discharge that has been emptied of its high-pressure cold gas stream. Advantageously, this results in gas flowing better between the nozzle and the gas-flow chamber, i.e. in better arc blasting, and therefore in increased breaking capacity for the circuit breaker.

The circuit breaker includes first drive means for driving the first and/or second sets of electrical contacts, and second drive means ensuring passage of the sealing means from their retracted position to their sealing position, and said second drive means comprise at least one movable part of the circuit breaker, which part is set into movement during the operation of opening said circuit breaker. In other words, the setting into movement of the parts for opening/closing the circuit breaker is judiciously used to advantage in order to move the means for sealing the opening between its two positions. By way of example, the first and second drive means may have one or more parts in common. In another example, the electrical contacts and/or the parts secured thereto, such as the blast nozzle, could form an integral part of these second drive means. Advantageously, that makes it possible to obtain good synchronization between the opening/closing operations, and the operations for driving the sealing means. Alternatively, separate means for driving the contacts and for driving the means for sealing the opening could be provided.

In any event, it is possible to implement various contrivances such as a spring, a lever system, or similar, in order to speed up/slow down one or both operations of the sealing means. In addition, as mentioned above, a non-linear drive train may be provided, e.g. in such a manner as to cause the circuit breaker to open and the sealing means to close at different instants.

In a first preferred embodiment of the invention, the sealing means comprise a sealing gasket that is mounted on the same axis as the side wall of the discharge cap, and that is movable axially relative thereto. Preferably, this gasket seals a single annular opening, or a plurality of openings distributed angularly about the axis of the side wall of the discharge cap.

In a second preferred embodiment of the invention, the sealing means comprise a shutter covering one or more openings in the sealing position, the shutter being mounted to pivot relative to the discharge cap. This shutter may be mounted on the side wall of the cap or equally on its end wall.

In a third preferred embodiment of the invention, the sealing means comprise at least one check valve, capable of passing from its retracted position to its sealing position under the effect of the gas pressure inside the gas-flow chamber, the circuit breaker being configured in such a manner that after the value reaches its sealing position, said position is maintained by additional maintaining means, independent of the gas pressure being exerted on the valve. These additional means are preferably mechanical means for maintaining the valve in the sealing position, designed to be released during the following operation of closing the circuit breaker, again in mechanical manner. Nevertheless, the use of other technologies may be envisaged, such as electromagnetic maintaining means. In this example also, it should be observed that the valve may be provided on the side wall of the discharge cap or on its end wall.

In addition, it should be observed that the arc-control chamber is preferably of the double-motion type, but could be of the single-motion type, without going beyond the ambit of the invention.

Finally, the invention provides a method of controlling a medium-, high-, or very high-voltage circuit breaker as described above, the method being characterized in that it comprises the following steps:

maintaining said sealing means in their retracted position when the circuit breaker is in the closed position; and causing said sealing means to pass from the retracted position to the sealing position, during an operation of opening the circuit breaker.

Other advantages and characteristics of the invention appear in the non-limiting detailed description given below.

BRIEF DESCRIPTION OF THE DRAWINGS

The description is made with reference to the accompanying drawings in which.

DETAILED DESCRIPTION OF PARTICULAR EMBODIMENTS

Figure 1A:
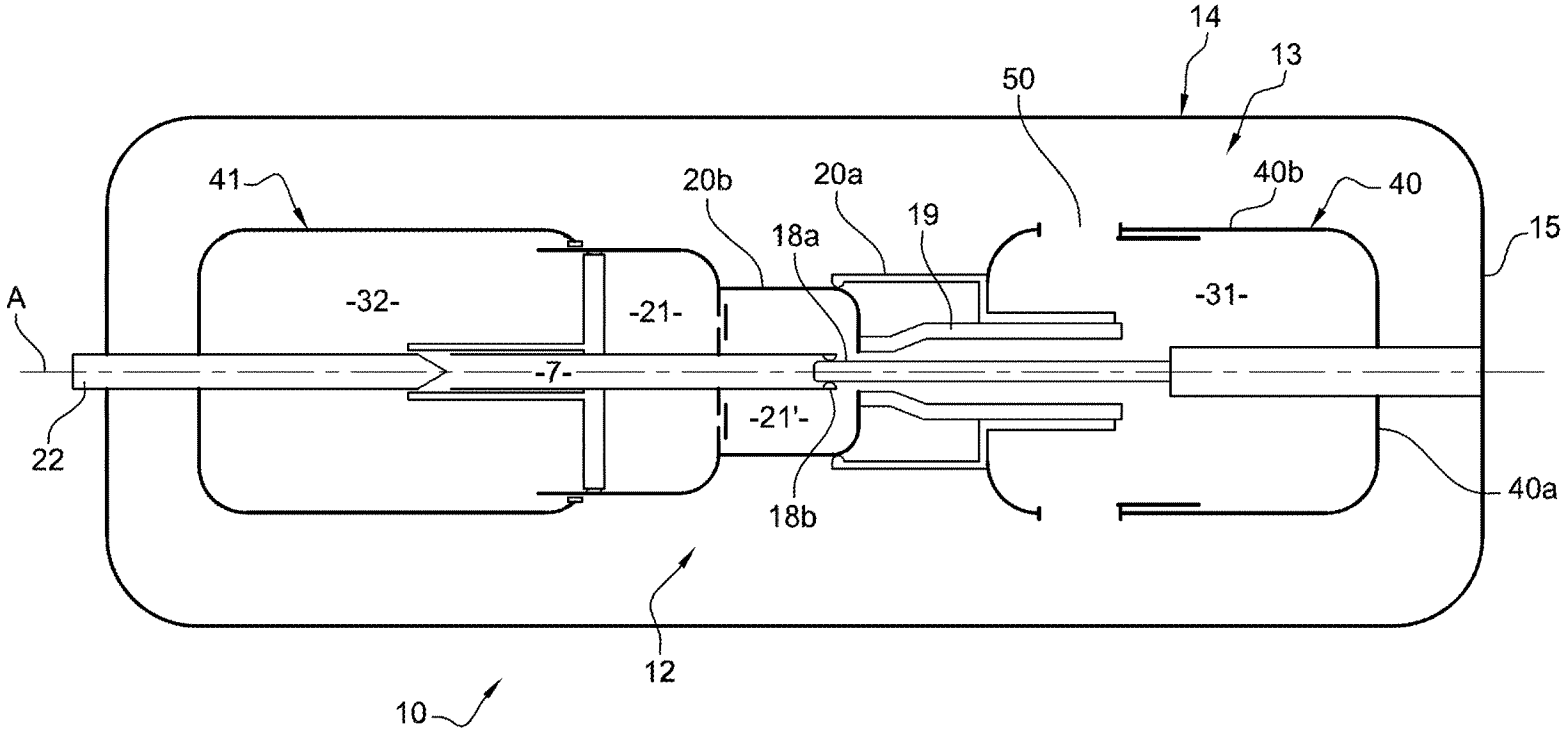
FIGS. 1*a* and 1*b* are diagrammatic views in longitudinal section of a high-voltage circuit breaker in a first preferred embodiment of the invention, with the circuit breaker being located respectively in a closed position and in an occupied position during an operation of opening the circuit breaker.
Figure 1B:
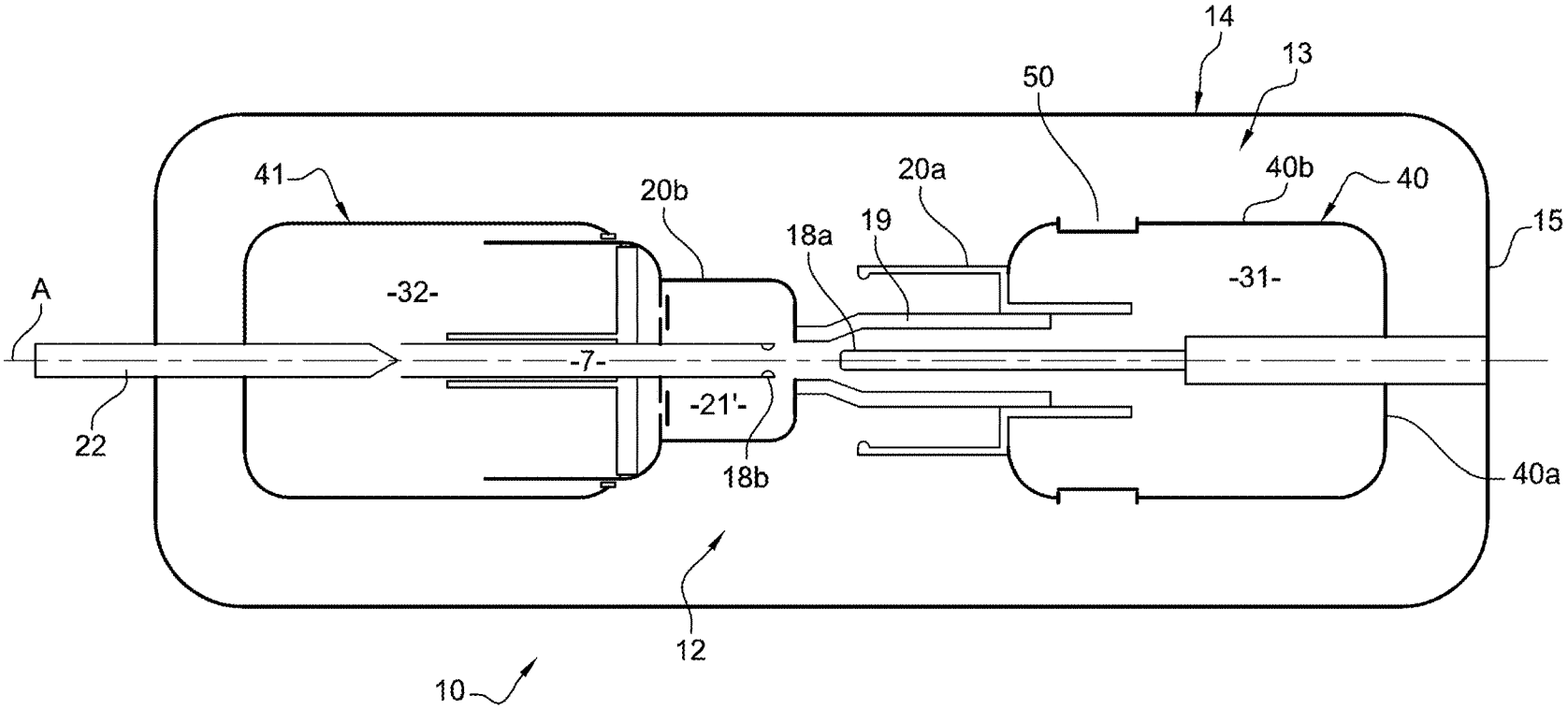

With reference initially to FIGS. 1*a* and 1*b*, there can be seen diagrams showing a high-voltage circuit breaker 10, in a preferred embodiment of the invention.

The circuit breaker 10 comprises an arc-control chamber 12. The arc-control chamber 12 is arranged inside a casing 14. The arc-control chamber 12 is thus placed in a space 13 that is internally defined by the outer casing 14. This space 13 is usually filled with an insulating gas, e.g. of the $SF_6$ type.

The chamber 12 includes a first set of electrical contacts 18*a*, 20*a*, and a second set of contacts 18*b*, 20*b*. More precisely, the first set comprises a first permanent contact 20*a* co-operating with a second permanent contact 20*b* of the second set, when the circuit breaker is in a closed position such as that shown in FIG. 1*a*. In addition, the first set comprises a first arcing contact 18*a*, co-operating with a second arcing contact 18*b* of the second set, when the circuit breaker is in its closed position. The first arcing contact 18*a* passes through a blast nozzle 19, made in conventional manner.

However, the invention is not limited to this embodiment. The invention may in particular be applied to double-motion circuit breakers. In order to perform such movement, any design deemed appropriate by the person skilled in the art may be used, e.g. the design described in French patent document No. FR 2 976 085. In such an example, the two sets are thus movable in sliding along the main axis A of the arc-control chamber 12, in opposite directions.

The second arcing contact 18*b* is surrounded by two volumes 21 and 21' separated axially from each other by a wall, and enabling the electric arc to be extinguished by blasting, so as to interrupt the current. The blast nozzle 19 makes it possible to channel the gas stream during said blasting.

The gas from the electric arc and the volumes 21 and 21' is evacuated axially on both sides by the nozzle 19 and the inside space 7 of the second arcing contact 18*b*. The gas escaping via the nozzle 19 penetrates into a gas-flow chamber 31, also known as a discharge chamber, which chamber is defined by a discharge cap 40 housed in the space 13. The chamber 31 is thus arranged at least in part downstream from the nozzle 19, the term "downstream" being considered along a main axial direction of the gas flow in the chamber 12, at the outlet of the nozzle 19.

In analogous manner, opposite from the arc-control chamber, the gas being discharged via the space 7 penetrates into another gas-flow chamber 32, defined by a discharge cap 41 that is also housed in the space 13.

Beside the first set of contacts 18*a*, 20*a*, the arc-control chamber 12 thus includes the discharge cap 40 forming an outer wall of the discharge volume 31. The discharge cap 40 includes an end wall 40*a* as well as a side wall 40*b* together defining, internally, the gas-flow chamber 31. In this embodiment, the side wall 40*b* includes an annular opening 50 for evacuating gas towards the space 13 defined by the tank 14. This opening 50 extends circumferentially over substantially 360° about the axis A, and extends axially along a considerable length of the cap, e.g. over 20% to 40% of the total length of the cap. The opening 50 is arranged near an upstream end of the cap 40, but naturally it may be arranged in some other way on the cap. The invention is also applicable whatever the configuration inside the chamber 31, and it is not limited to the particular embodiments described with reference to FIG. 2 et seq.

In the invention, the cap 40 is fitted with means 52 for sealing the annular opening 50. These sealing means are movable between a sealing position that is shown in FIG. 1*b* and in which they prevent gas from passing through the opening 50, and a retracted position that is shown in FIG. 1*a* and in which they allow gas to pass. In addition, the circuit breaker is configured in such a manner that in its closed position, the sealing means 52 are in their retracted position, and in such a manner that passage from the retracted position to the sealing position takes place during an operation of opening the circuit breaker. This principle that is specific to the invention is described below in reference to FIGS. 2 and 3, in which the circuit breaker adopts a particular non-limiting configuration of the invention.

First of all, it should be observed that the two sets 18*a*, 20*a*, 18*b*, 20*b* are driven simultaneously by a control mechanism comprising an operating rod 22 that is centered on the axis A of the arc-control chamber 12, and that is movable axially in sliding in the arc-control chamber. The operating rod 22 drives a drive member 24 that, in this example, consists of a return lever that is mounted to pivot on a stationary portion of the arc-control chamber 12 about an axis 25 that is perpendicular to the plane of FIG. 2. It should be understood that the invention is not limited to this embodiment of the drive member 24, which could also consist of a cam, a roller, or a rack that is implemented in such a manner as to drive the contacts.

The lever 24 is connected to the operating rod 22 by means (not shown), in such a manner that sliding of the rod 22 causes the lever to pivot 24 in one direction or the other.

The sets of electrical contacts are connected to the return lever 24 in such a manner that the first contacts 18*a*, 20*a* and the second contacts 18*b*, 20*b* move simultaneously and in opposite directions during pivoting of the lever 24.

Moving the contacts in opposite directions has the main advantage of obtaining a high relative speed of movement, while maintaining a lower contact speed relative to the stationary portions of the arc-control chamber 12.

In this example, the lever 24 consists in an oblong element, having its longest length transverse relative to the main axis A of the arc-control chamber 12. The lever 24 is pivotally mounted at its center inside the arc-control chamber 12, and its ends are connected to the electrical contacts by means of links 26, that are possibly resilient.

A pivot member 28 that is mounted on the stationary portion of the arc-control chamber 12 serves to hinge the lever 24 about the axis 25. The pivot member 28 and the lever 24 are arranged in an inside portion 30 of the gas-flow chamber 31, defined internally by a tubular wall 33 that is centered on the axis A.

The inside portion 30 of the cylindrical gas-flow chamber 31 is defined at its upstream axial end by the nozzle 19, i.e. beyond a contact support 34 arranged substantially orthogonal to the axis A. The first set of contacts 18*a*, 20*a* is mounted to slide relative to the tubular wall 33, along the axis A. The movable support 34 is arranged inside this same wall 33 forming a tube in the discharge chamber 31.

In the upstream portion 36, the chamber 31 forms a blast chamber 36 that begins beside the nozzle 19. Also, the blast chamber 36 extends axially, from upstream to downstream, between the nozzle 19 and the support 34 of the first set of electrical contacts.

The support 34 causes the shape of the blast chamber 36 to vary when it moves axially during opening and closing operations and enables fluid communication to take place between both sides of said support. Suitable orifices are thus made through the support 34, so that gas may pass therethrough.

Beside the first set of contacts 18*a*, 20*a*, the arc-control chamber 12 comprises the discharge cap 40, having its side wall 40*b* surrounding the tubular wall 33. The end wall 40*a* of the gas-flow chamber 31 is located remote from the support 34. It extends laterally beyond the wall 33, to join the side wall 40*b*.

An annular gas-discharge space 42 is then defined between the side wall 40*b* and the tubular wall 33, this space 42 forming an integral part of the gas-flow chamber 31, by constituting its external portion.

The gas streaming in the inside portion 30 of the chamber 31 may penetrate into said space 42 by means of holes 44 drilled in the wall 33. In addition, at its end situated opposite the end wall 40*a*, the cap 40 remains open and defines a discharge opening 46 of annular shape and of small section. This annular opening 46, defined internally by the wall 33, is directed axially in a direction away from the end wall of the circuit breaker. Nevertheless, a baffle-forming part 48 (shown in the following figures) makes it possible to redirect the gas stream towards the end wall of the circuit breaker, after its exit via the discharge opening 46. At the outlet of the baffle, the gas penetrates into the space 13 defined by the tank 14, outside the arc-control chamber 12.

Moreover, it should be observed that the end 15 of the tank, shown in FIG. 1*a*, is connected to the end 40*a* while being at a distance therefrom, the mechanical connection preferably being made by means of an insulating support (not shown) that is arranged between the two elements 40*a*, 15.

As mentioned above, the side wall 40*b* of the cap 40 is fitted in this example with an opening 50 for evacuating gas from the annular space 42, towards the space 13 defined by the tank 14. The means for sealing the opening 52 are in this example movable between a retracted position shown in FIG. 2, in which the gas can pass through the opening 50 in the direction of the space 13, and a sealing position shown in FIG. 3, preventing the passage of this gas in the direction of this same space.

In the first preferred embodiment, the sealing means 52 take the shape of a sealing ring centered on the axis A, and movable relative to the wall 33 along said same axis. In the embodiment shown in FIGS. 2 and 3, the ring 52 is arranged inside the tubular wall 33, but could be placed outside, without going beyond the ambit of the invention. Certain elements of the first drive means for the electrical contacts, in particular the pivot member 28 and the lever 24, also form an integral part of the second drive means for the sealing ring 52. Indeed, a mechanical connection member 54 is put in place between an end of the lever 24, and the ring 52. Also, when the lever 24 and the member 28 are moved to cause the circuit breaker to open or to close, they simultaneously drive movement of the ring 52 from its retracted position to its sealing position, or vice versa.

Figure 2:
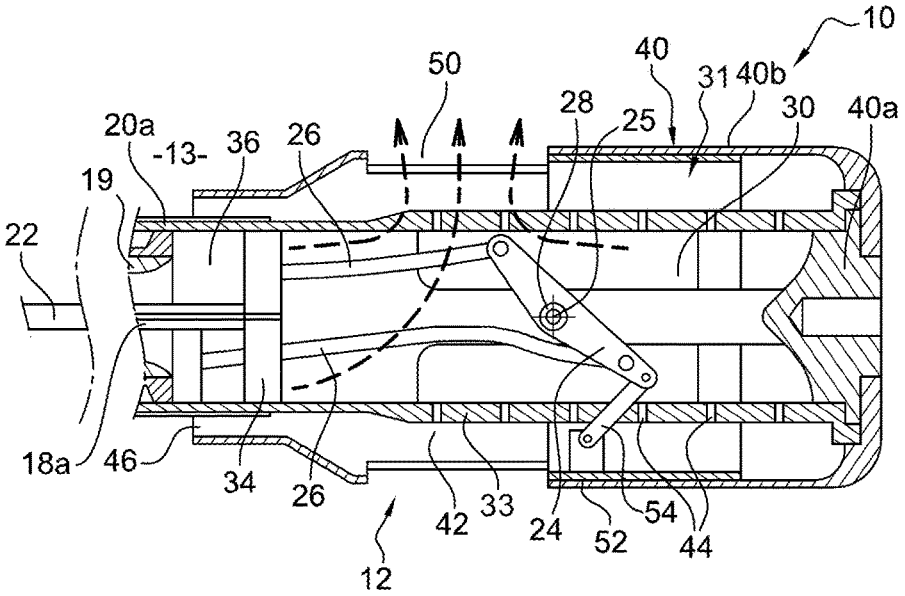
FIG. 2 shows an enlarged portion of the circuit breaker shown in the above-described figures, with the circuit breaker being located in the closed position.

In the closed position of the circuit breaker 10, as shown in FIG. 2, the sealing ring 52 is in its retracted position. The heating due to the passage of current between the contacts can be attenuated by natural convection, causing the heat to be evacuated via the opening 50, towards the large-volume space 13.

Figure 3:
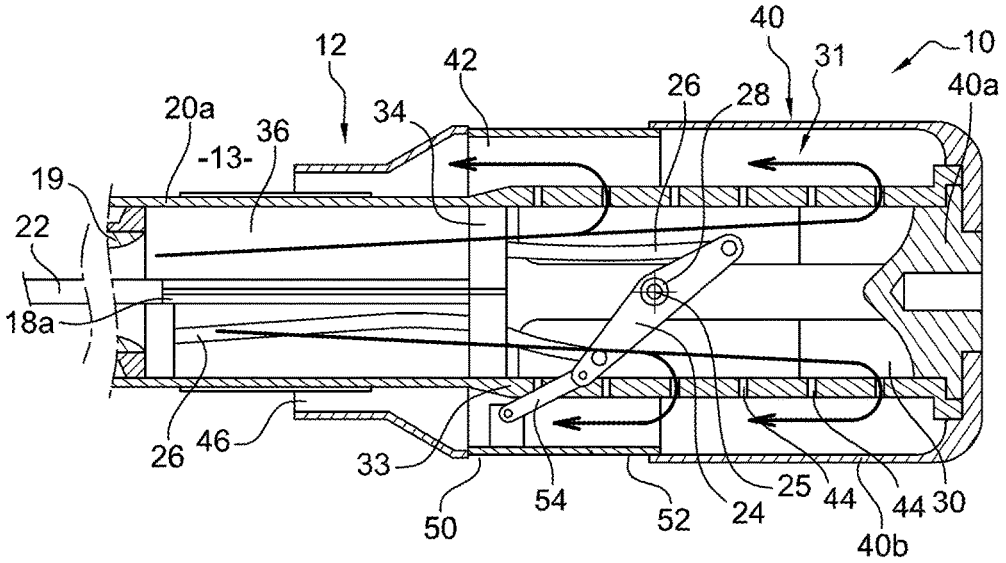
FIG. 3 is a view similar to that of FIG. 2, with the circuit breaker being located in an occupied position during an operation of opening the circuit breaker.

When an operation of opening the circuit breaker is initiated, for interrupting current, the moving lever 24 causes the sealing ring 52 to move towards its sealing position shown in FIG. 3. That then enables the hot gas resulting from blasting the arc to travel through the chamber 31, while streaming successively via the arc-control chamber 36, the inside portion 30 of the chamber 31, the holes 44, the annular discharge space 42, and then the annular opening 46. When leaving the chamber 31 via the opening 46, the hot gas then reaches the large-volume space 13. By preventing the hot gas from being discharged via the opening 50, the risk of the tank 14 being damaged by this gas and the microparticles it entrains is found to be limited, as is the risk of arcing.

The circuit breaker is designed so that the opening 50 is maintained sealed for the entire duration of the operation of opening the circuit breaker, and is released only during the following closing operation, still under the effect of the action of the lever 24.

As mentioned above, it could be arranged for the passage from the retracted position to the sealing position to take place after initiation of the operation of opening the circuit breaker, and not at the same instant as this initiation. That would make it possible to evacuate all or part of the high-pressure cold front that is present in the chamber 31, just after an operation of opening the circuit breaker has been initiated. As a result of evacuating the initial high-pressure cold front, the pressure in the chamber 31 is reduced, and the mechanical forces required for moving the electrical contacts are advantageously reduced. Arc blasting is also improved, because of the increase in the difference in pressure between the core of the nozzle 19 and the discharge.

Figure 4:
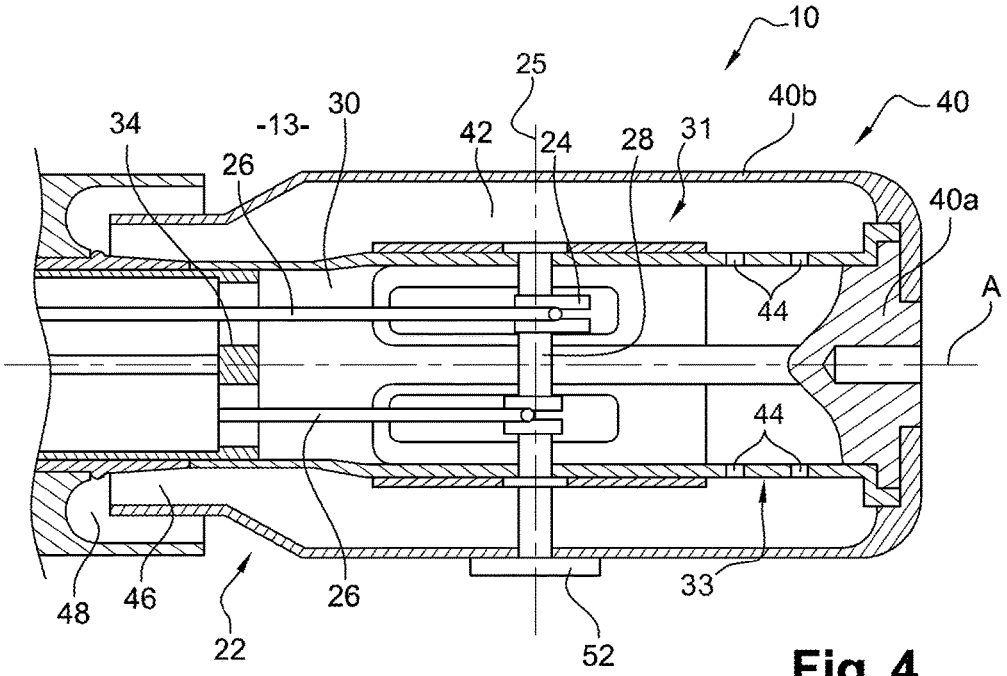
FIG. 4 shows a diagrammatic longitudinal section view of a portion of a high-voltage circuit breaker, in a second preferred embodiment of the invention.
Figure 5A:
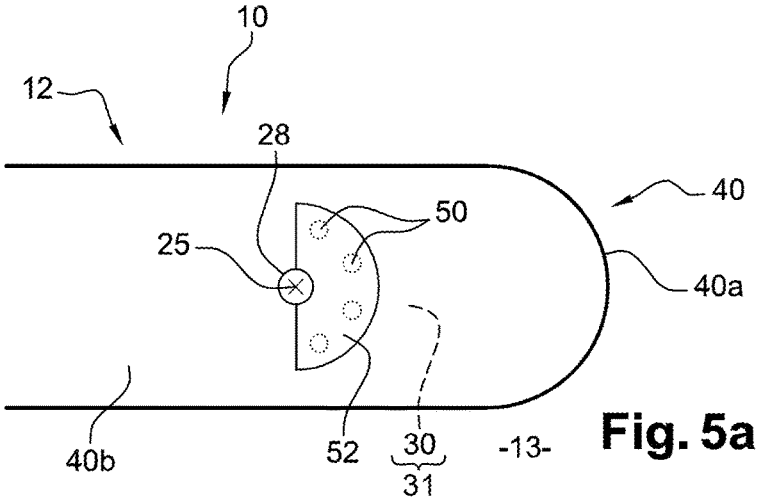
FIGS. 5*a* and 5*b* are aerial views of the portion of the circuit breaker shown in the above-described figure, in two different configurations respectively.
Figure 5B:
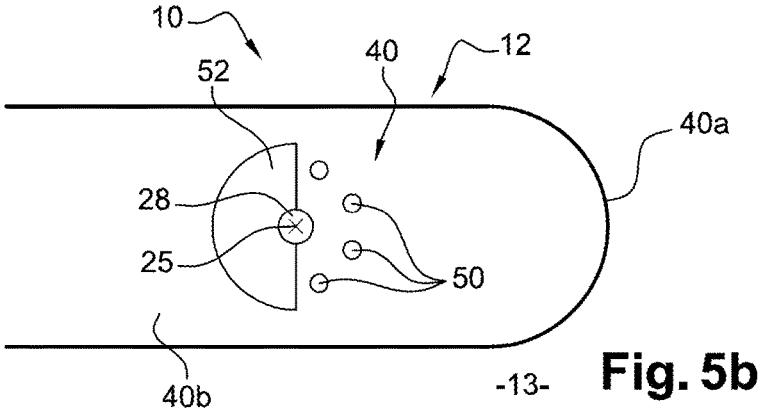

A second preferred embodiment is described below in reference to FIGS. 4 to 5*b*. This second preferred embodiment, just like the third embodiment that is described below, presents great similarities with the first above-described embodiment. Also, in the figures, the elements given the same numerical references correspond to identical or similar elements.

In the second embodiment, a plurality of openings 50 of small section are made in the side wall 40*b* of the discharge cap 40. These openings are grouped together, and cooperate with a shutter 52 that is operated in pivoting about the same axis 25 as that of the pivot member 28 that is used to drive the lever 24 or similar in pivoting. Here also, in a sealed position, the shutter 52 covers the openings as shown in FIG. 5*a*, while in the retracted position shown in FIG. 5*b*, the shutter 52 is offset from the openings 50, thus allowing gas to pass. In this example, the shutter is in the shape of a half-disc, cooperating with a flattened portion of the wall 40*b* in which the openings 50 are made.

The shutter 52 is arranged externally on the wall 40*b*, but could be arranged internally, without going beyond the ambit of the invention.

Furthermore, another group of openings 50 may be made at the opposite end of the member 28, while still being associated with a shutter operated by this same member 28, that is used to perform opening and closing operations of the circuit breaker.

Figure 6:
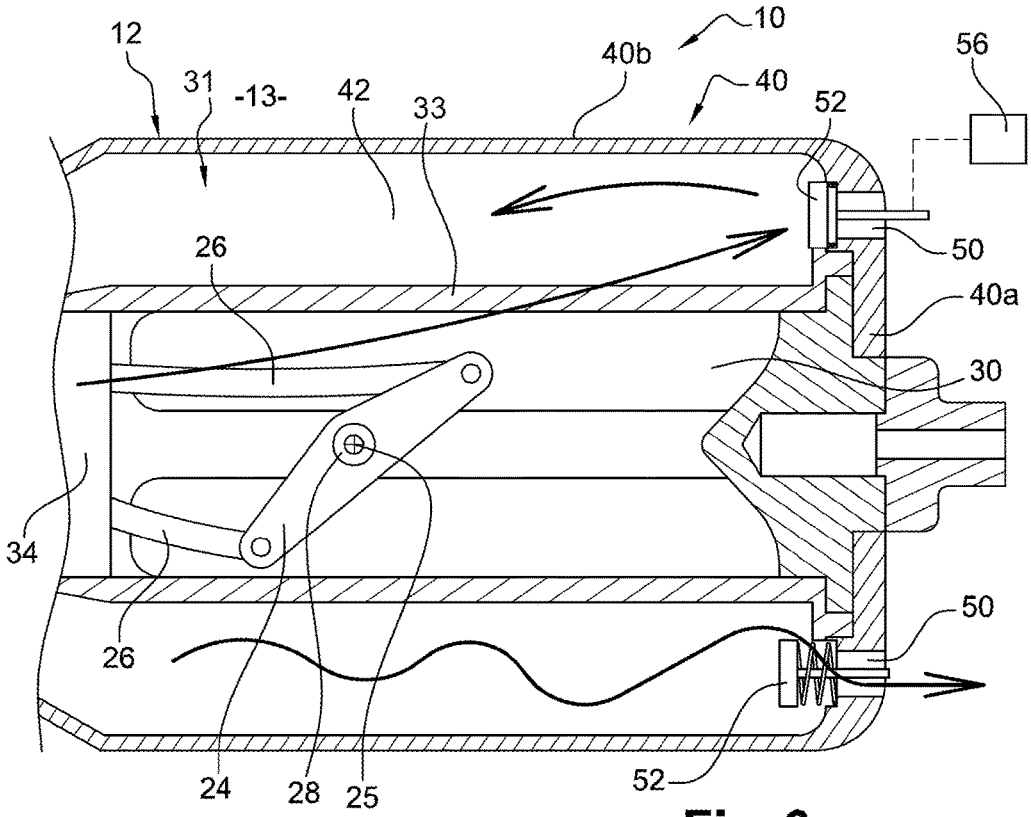
FIG. 6 shows a diagrammatic longitudinal section view of a portion of a high-voltage circuit breaker, in a third preferred embodiment of the invention.
Figure 7:
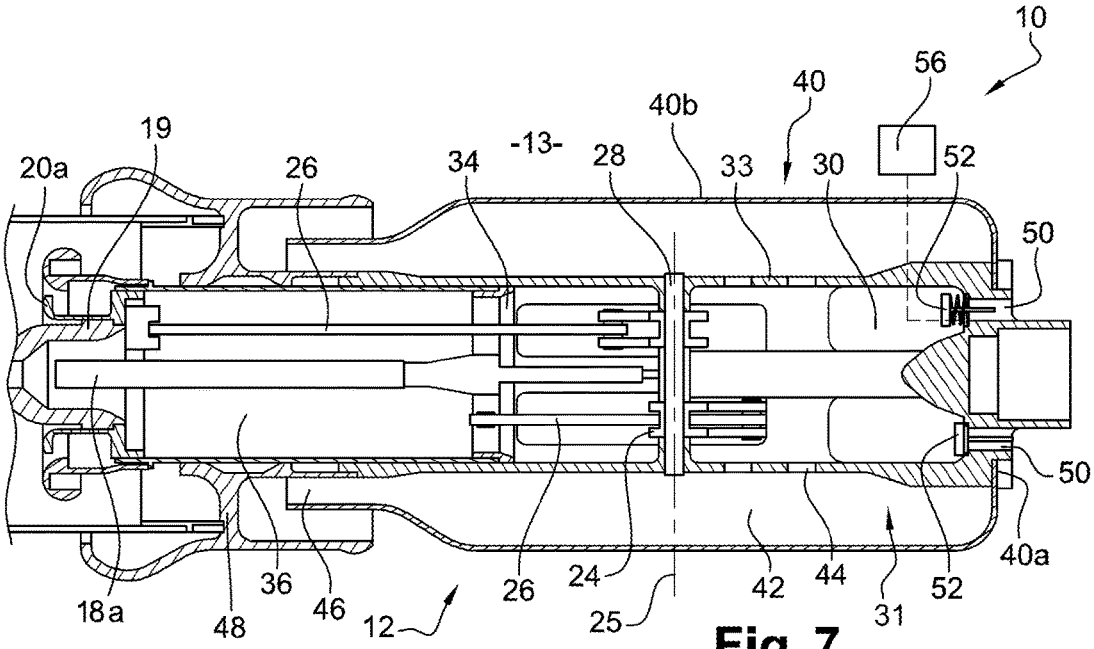
FIG. 7 shows a view similar to that of FIG. 6, with the circuit breaker simply in the form of an alternative embodiment.

Reference is now made to FIG. 6, which shows a third preferred embodiment in which the openings 50 are made through the end wall 40*a* of the discharge cap 40. In this example, these openings 50 open out into the annular space 42, forming the outside portion of the gas-flow chamber 31. In the alternative embodiment shown in FIG. 7, these openings are closer to the axis A and they open out into the inside portion 30 of the chamber 31.

In both cases, the sealing means 52 take the form of a check valve associated with each opening 50. The valves 52 take the conventional form of spring valves, having particular operation that is described below.

In the neutral position at rest, the spring of each valve 52 leads said valve to release its associated opening, so that the valve adopts the retracted position making it possible for the chamber 31 and the space 13 to communicate via the associated opening 50. This retracted position, as shown for the valve 52 at the bottom of FIG. 6, is adopted when the circuit breaker is in the closed position.

During an opening operation, the above-mentioned cold front under pressure travels downstream towards the end wall 40*a* and, because of its high pressure, presses against each valve, which then moves into its sealing position. This position is shown for the valve 52 at the top of FIG. 6. Since the gas pressure decreases after the passage of said cold front, the circuit breaker is provided with additional mechanical maintaining means 56 serving to maintain each valve 52 in its sealing position. In addition, this sealing position is maintained even though the pressure inside the chamber 31 is insufficient to generate enough force on these same valves to maintain them in the closed position. These additional means, of design that can take any form considered suitable by the person skilled in the art, thus make it possible to act on the position of the valves 52, independently of the pressure that is exerted on them.

Consequently, during the operation of opening the circuit breaker, the valves 52 can be maintained closed, and the risks of hot gas attacking the tank remain limited, as do the risks of arcing.

In addition, the additional means 56 are preferably designed to release the valves 52 mechanically during the following operation of closing the circuit breaker, e.g. during initiation thereof.

Finally, it should be observed that these means that are specific to the invention and that are described in association with the gas-flow chamber 31, can also be implemented in identical or analogous manner in association with the other gas-flow chamber 32, located on the opposite side of the nozzle.

Naturally, various modifications may be applied to the above-described invention by the person skilled in the art without going beyond the ambit of the invention.

What is claimed is:

1. A medium-, high-, or very high-voltage circuit breaker, comprising at least one arc-control chamber and an outer casing defining a space in which the arc-control chamber is arranged, said arc-control chamber comprising:

a first set of electrical contacts and a second set of electrical contacts, at least one of the first and second sets being movable in such a manner as to enable closing and opening operations of the circuit breaker;

an arc blast nozzle; and a discharge cap situated in the space and comprising an end wall and a side wall internally defining a gas-flow chamber situated at least in part downstream from the blast nozzle, the discharge cap including at least one opening for discharging gas;

the circuit breaker including sealing means for sealing said opening, said sealing means being movable between a sealing position in which said sealing means prevent the gas from passing through the opening, and a retracted position in which said sealing means allow passage therethrough, the circuit breaker being configured in such a manner that in a closed position, said sealing means are in the retracted position, and in such a manner that passage from the retracted position to the sealing position takes place during an operation of opening the circuit breaker.

2. The circuit breaker according to claim 1, wherein the circuit breaker is configured in such a manner that the sealing position is maintained until an end of the operation of opening the circuit breaker, and in that the passage from the sealing position to the retracted position takes place during a following operation of closing the circuit breaker.

3. The circuit breaker according to claim 1, wherein the circuit breaker is configured in such a manner that passage from the retracted position to the sealing position takes place after the operation of opening the circuit breaker has been initiated.

4. The circuit breaker according to claim 1, wherein the circuit breaker includes first drive means for driving the first and/or second sets of electrical contacts, and second drive means ensuring passage of the sealing means from the retracted position to the sealing position, and in that said second drive means comprise at least one movable part of the circuit breaker, which part is set into movement during the operation of opening said circuit breaker.

5. The circuit breaker according to claim 1, wherein the sealing means comprise a sealing gasket that is mounted on a same axis as the side wall of the discharge cap, and that is movable axially relative thereto.

6. The circuit breaker according to claim 1, wherein the sealing means comprise a shutter covering one or more openings in the sealing position, the shutter being mounted to pivot relative to the discharge cap.

7. The circuit breaker according to claim 1, wherein the sealing means comprise at least one check valve, capable of passing from the retracted position to the sealing position under an effect of a gas pressure inside the gas-flow chamber, and in that the circuit breaker is configured in such a manner that after reaching the sealing position of the valve, said position is maintained by additional maintaining means, independent of the gas pressure being exerted on the valve.

8. A method of controlling a medium-, high-, or very high-voltage circuit breaker according to claim 1, the method comprises the following steps:

maintaining said sealing means in the retracted position when the circuit breaker is in the closed position; and causing said sealing means to pass from the retracted position to the sealing position, during the operation of opening the circuit breaker.

* * * * *